United States Patent [19]

Bresson et al.

[11] Patent Number: 4,579,651

[45] Date of Patent: Apr. 1, 1986

[54] FLOTATION REAGENTS

[75] Inventors: Clarence R. Bresson; Robert M. Parlman, both of Bartlesville, Okla.

[73] Assignee: Phillips Petroleum Company, Bartlesville, Okla.

[21] Appl. No.: 689,675

[22] Filed: Jan. 8, 1985

Related U.S. Application Data

[60] Division of Ser. No. 489,846, May 6, 1983, Pat. No. 4,556,500, which is a continuation-in-part of Ser. No. 387,393, Jun. 11, 1982, abandoned.

[51] Int. Cl.[4] ..... B03D 1/02

[52] U.S. Cl. ..... 209/166; 252/61

[58] Field of Search ..... 209/166, 167; 252/61

[56] References Cited

U.S. PATENT DOCUMENTS

| | | | |
|---|---|---|---|
| 1,833,740 | 11/1931 | Derby et al. | 209/166 |
| 2,203,740 | 6/1940 | Ott | 209/166 |
| 4,211,644 | 7/1980 | Wiechers | 209/166 |
| 4,341,715 | 7/1982 | Parlman et al. | 209/166 |
| 4,424,123 | 1/1984 | Parlman et al. | 209/166 |
| 4,521,300 | 6/1985 | Parlman et al. | 209/166 |

*Primary Examiner*—Bernard Nozick

[57] ABSTRACT

A composition and process are provided for the recovery of the values of zinc, molybdenum, copper, lead, iron (pyrite), and iron-containing small amounts of gold or uranium, or both, from ores comprising these mineral sulfides. The aqueous composition is the impure form of an alkali metal alkyl trithiocarbonate compound. The process comprises employing said aqueous composition as a collection agent for the above minerals in an ore recovery process.

A process for the separation of zinc values from lead values from a ore comprising both is provided by employing an alkali metal alkyl trithiocarbonate compound as a collection agent for zinc.

In addition, both a composition and process are provided for the recovery of the values of iron, copper, and lead from ores comprising these values. The composition consists essentially of a dispersant and an impure form of an alkali metal alkyl trithiocarbonate compound. The process comprises employing this composition as a collection agent for the above minerals in an ore recovery process.

5 Claims, No Drawings

FLOTATION REAGENTS

This application is a divisional of our copending application Ser. No. 489,846, filed May 6, 1983 now U.S. Pat. No. 4,556,500, which was a continuation-in-part of our application Ser. No. 387,393, filed June 11, 1982, now abandoned.

This invention relates to novel compositions and processes used in flotation processes for recovering minerals from their ores.

Froth flotation is a process for separating minerals from ores. In a froth flotation process, the ore is crushed and wet ground to obtain a pulp. Additives such as collectors, or mineral flotation agents, frothing agents, suppressants and the like are added to the pulp to assist in subsequent flotation steps in separating valuable minerals from the undesired portion of the ore. The pulp is then aerated to produce a froth at the surface. The minerals which adhere to the bubbles or froth are skimmed or otherwise removed and the mineral-bearing froth is collected and further processed to obtain the desired minerals.

It is already known in the art that several compounds such as xanthates, amines, alkyl sulfates, arene sulfonates, dithiocarbamate, dithiophosphates, and thiols are useful as mineral flotation collectors. The suggestion of the use of tertiary-alkyl trithiocarbonates as possible ore flotation collectors is suggested in U.S. Pat. No. 2,600,737. *Industrial and Engineering Chemistry*, Vol. 42, No. 5, p. 918 discloses the use of sodium tertiary alkyl trithiocarbonates as collectors, particularly of copper in the flotation of sulfide ores.

A continued need exists in the ore recovery and refining technology for effective compositions and processes for enhanced recovery of mineral sulfides in ore flotation processes.

It is thus an object of this invention to provide novel compositions suitable for use as a collector in an ore flotation process. It is a further object of this invention to provide an improved process for the recovery of the sulfides of lead, zinc, copper, molybdenum, iron, and iron-containing small amounts of uranium and gold minerals in an ore recovery process.

Other aspects, objects, and the several advantages of the present invention will become apparent upon reading this specification and the appended claims.

In accordance with one embodiment of the present invention, a novel aqueous composition effective as a collector in an ore recovery process is provided and is made according to the process comprising: (a) reacting in a aqueous solution either a Group IA alkali metal or ammonium hydroxide with a mercaptan represented by the formula R-SH wherein R is an alkyl or alkenyl radical of from 2 to 12 carbon atoms and (b) thereafter to the resulting reaction product adding carbon disulfide in an amount sufficient to effect formation of the desired aqueous composition.

In accordance with another embodiment of this invention, a process for the recovery of at least one of the sulfides of Pb, Zn, Mo, Cu, Fe, or Fe-containing small amounts of gold or uranium, or both, in an ore recovery process is provided by employing the novel aqueous composition described above as a collection agent. For the purposes of this invention, the amount of uranium and gold defined as small amounts in pyrite is for uranium to be present in pyrite in an amount from about 0.001 wt. % to about 1.0 wt. % and for gold to be present in pyrite in an amount from about $5\times10^{-8}$ wt. % to about $5\times10^{-6}$ wt. %.

In accordance with still another embodiment of this invention, a process for the separation of zinc from lead in an ore comprising same is provided, the step comprising: (a) floating lead in the presence of a collector for lead values; (b) activating the remaining zinc by addition of a soluble copper salt in an amount sufficient to activate said zinc present in said ore; and (c) thereafter floating the resulting activated zinc values in the presence of at least one trithiocarbonate compound represented by the general formula:

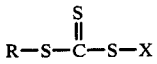

where R is an alkyl or alkenyl radical having from 2 to 12 carbon atoms and X is either ammonium or a Group IA alkali metal.

The aqueous composition disclosed above can be derived from the reaction according to the following equation:

wherein R is an alkyl or alkenyl radical with from 2 to 12 carbon atoms anb X is a Group IA alkali metal or ammonium. This aqueous composition can also be referred to as an impure or crude form of an alkyl trithiocarbonate salt.

The above aqueous composition is prepared by reacting either a Group IA alkali metal or ammonium hydroxide with an alkyl or alkenyl mercaptan wherein said alkyl or alkenyl group has from 2 to 12 carbon atoms. After the above reaction mixture has cooled, $CS_2$ can be added to the resulting reaction product in an amount sufficient to effect formation of the desired aqueous composition. The solution can then be used directly without further separation or purification.

It is preferred that the alkali metal or ammonium hydroxide and the alkyl or alkenyl mercaptan be reacted in approximately equivalent amounts. For the purposes of the present invention, approximately equivalent amounts is defined as being amounts of each compound present such that the molar ratio of X-OH to R-SH is about 1.05 to 1.0.

In the process of another embodiment of the present invention, an effective amount of the aqueous composition described in the first embodiment is used as a collection agent for values of molybdenum, lead, zinc, copper, iron and iron-containing small amounts of uranium, gold, or both in an ore recovery process. For the purposes of this invention, an effective amount of aqueous composition is defined to be that amount of the composition necessary to effectuate the desired mineral sulfide recovery. Generally, the concentration of aqueous composition employed in the present invention is from about 0.005 lb/ton of ore to 0.5 lb/ton of ore, more preferably from about 0.01 to 0.1 lb/ton of ore.

In a preferred embodiment of this invention, an effective amount of the aqueous composition is employed as a collection agent directly before each flotation step in the ore recovery process.

Any froth flotation apparatus can be used in this invention. The most commonly used commercial flotation machines are the Agitor (Galigher Co.), Denver D-2 (Denver Equipment Co.) and the Fagergren (Western Manufacturing Co.). Smaller laboratory scale apparatus such as the Hallimond cell can also be used.

Frothing agents which may be used in the present invention include polypropylene and polyethylene glycols and the corresponding methyl or ethyl ethers. In addition, isophorone and methyl isobutyl carbinol should be included.

In the process of still another embodiment of the present invention, a process for the separation of zinc from lead in an ore comprising the same is provided, the step comprising: (a) floating lead in the presence of a collector for lead values; (b) activating the remaining zinc by addition of a soluble copper salt in an amount sufficient to activate said zinc present in said ore; and (c) thereafter floating the resulting activated zinc values in the presence of at least one trithiocarbonate compound represented by the general formula:

$$R-S-\overset{\overset{\displaystyle S}{\|}}{C}-S-X$$

where R is an alkyl or alkenyl radial having from 2 to 12 carbon atoms and X is either ammonium or a Group IA alkali metal.

Any collection agent suitable for collecting lead values can be utilized in the process of the present invention. Typical collection agents used are alkali metal alkyl xanthates, isopropyl ethyl thionocarbamates, and methyl isobutyl thionocarbamates. Presently preferred is sodium isopropyl xanthates because of ready availability and economical cost.

In addition, any soluble copper salt may be used to activate the Zn values remaining in the ore. Typical examples are copper(II) sulfate and copper(II) ammonium chloride. Whatever soluble copper salt is used, it should be added in an amount sufficient to activate the remaining Zn values.

The particular alkali metal alkyl trithiocarbonate desired can be obtained from the reaction described previously:

$$XOH + R-SH + CS_2 \xrightarrow{\text{water}} R-S-\overset{\overset{\displaystyle S}{\|}}{C}-S-X + H_2O$$

where X and R have the same designations as given earlier. The process of reacting the above ingredients is the same as described earlier. It is presently preferred that the alkali metal alkyl trithiocarbonate containing aqueous product formed by the above reaction be utilized as a collection agent for zinc. This latter compound can be referred to as the impure form.

In accordance with the present invention, we now have further discovered that a novel composition consisting essentially of (a) dispersant of the formula $$HO\left(CHR'\underset{\underset{\displaystyle CH_3}{|}}{C}H-O\right)_y R'$$

wherein R' is either hydrogen, methyl, or ethyl and y is an integer from 6 to 17, the dispersant having a molecular weight in the range of from about 300 to about 1000 and (b) the novel aqueous composition described earlier resulting from the reaction of RSH, XOH, and $CS_2$ in the presence of water wherein R and X are as earlier defined herein, is useful as a collection agent for the recovery of copper, iron, and lead values.

Preferably, the molecular weight of the dispersant will be from about 400 to about 750.

Examples of dispersant contemplated for use in the present invention are polypropylene glycol 400, 425, 750, and 900, polybutylene glycol, and polypentylene glycol along with the corresponding monomethyl and monoethyl ethers.

Generally, the ratio of (b):(a) can be from about 80:20 to about 99:1 parts by weight, and preferably from about 90:10 to about 98:2 parts by weight.

In the present invention, the novel composition described immediately above may be used as a collection agent for lead, copper, and iron values in an ore recovery process. Generally, the concentration of novel composition is from about 0.005 lb/ton of ore to 0.5 lb/ton of ore, more preferably from about 0.01 to 0.1 lb/ton of ore.

In a preferred embodiment, an effective amount of the aqueous composition is employed as a collection agent directly before each floation step in the ore recovery process.

The froth flotation apparatus and frothing agents described in an earlier embodiment of the present invention are applicable in this embodiment of the present invention also.

The instant invention was demonstrated in tests conducted at ambient room temperature and atmospheric pressure. However, any temperature or pressure generally employed by those skilled in the art is within the scope of this invention.

The following examples illustrate the various embodiments of the present invention.

EXAMPLE I

This example described a typical procedure used to prepare the 40 percent aqueous solution of sodium n-butyl trithiocarbonate used herein without purification as the inventive mineral collector system. This is referred to herein as "impure" sodium n-butyl trithiocarbonate. To a 12-liter round bottom glass flask equipped with a stirrer, thermometer and reflux condensor was added 4.75 liter of water and 792 grams (19.8 moles) sodium hydroxide. After the hydroxide had dissolved there was slowly added 1632 grams (18.13 moles) of n-butyl mercaptan. When the reaction temperature had cooled below 45° C., 1371 grams (18.03 moles) of carbon disulfide was slowly added with stirring. After all of the carbon disulfide had been added, the mixture was stirred for about one hour, cooled to ambient room temperature and bottled. The mixture was dark orange in color and was homogeneous and was considered to be essentially a 40 weight percent aqueous solution of sodium n-butyl trithiocarbonate. Less than about 8 to 9 weight percent impurities were present identified as sodium hydroxide, n-butyl mercaptan, carbon disulfide, dibutyl trithiocarbonate and di-n-butyl disulfide.

EXAMPLE II

This example describes the procedure used to prepare a "pure" sample of sodium n-butyl trithiocarbonate. To a reaction flask equipped as previously described was added 200 milliliters of isopropyl alcohol and 60 grams (1.5 moles) sodium hydroxide. After the hydroxide dissolved there was added by way of a dropping funnel 135.29 grams (1.5 moles) of n-butyl mercaptan. When the temperature cooled below 45° C. there was slowly added 114.2 grams (1.5 moles) of carbon disulfide. Before the addition of carbon disulfide was complete, the reaction mixture colored and became homogeneous. Upon cooling to ambient room temperature a precipitate formed which was removed by filtration, washed with cold toluene followed by several cold washes of n-hexane. The crystals were dried in a vacuum desiccator and considered to be essentially "pure" sodium n-butyl trithiocarbonate.

EXAMPLE III

This example describes the evaluation of the salts prepared in Examples I and II as ore flotation agents. To a ball mill was added 1500 grams of a Mo, Cu, Fe-containing crushed ore (Kennecott Copper-Chino Mining Co.) along with 1000 milliliters of water, 2.5 grams lime, 0.10 lb/ton ore (11 drops) of an aromatic oil and the mixture ground for 20 minutes to 18 percent+100 Tyler mesh screen size. The slurry was transferred to a 5 Liter Denver D-12 flotation cell along with enough water to fill the cell to 1.5 inches from the lip (about 35 wt. % aqueous solids). Also added to the cell while stirring the contents at 1200 rpm was added enough lime to give a pH of 10.8, 5 drops of frother (Chino, in-house) and 0.03 lb/ton of an aqueous solution containing 40 weight percent "impure" sodium n-butyl trithiocarbonate prepared as described in Example I. The mixture was conditioned for 2 minutes and floated for 7.5 minutes. The floated concentrate was filtered, dried, and analyzed. The procedure was repeated except "pure" sodium n-butyl trithiocarbonate prepared as described in Example II was used as a 40 weight percent aqueous solution instead of "impure" sodium n-butyl trithiocarbonate. The results which are listed in Table I show a slightly higher Mo and Cu recovery when the "impure" sodium n-butyl trithiocarbonate is used as compared to the "pure" trithiocarbonate.

EXAMPLE IV

This example describes another ore flotation evaluation using the "impure" and "pure" salts herein described. The procedure described in Example III was essentially repeated but using a different ore. To a ball mill was added 1000 grams of crushed ore (Palabora-South America) along with about 666 milliliters water. The grind time was 8 minutes 15 seconds to give a 60%+200 Tyler mesh screen size ore. The slurry was transferred to a 3 liter Wemco flotation cell along with 0.05 lb/ton frother (Dowfroth 250) and 0.017 lb/ton collector, 40 weight percent "aqueous" impure sodium n-butyl trithiocarbonate prepared by the method described in Example I. The mixture was conditioned for 15 seconds and floated for 5 minutes whereupon more collector was added, 0.0034 lb/ton along with additional frother, 0.02 lb/ton, and the float continued for another 3 minutes. The combined floats were flitered, dried and analyzed. The procedure was repeated except "pure" sodium n-butyl trithiocarbonate obtained according to Example II was employed as the collector instead of the "impure" trithiocarbonate. The results listed in Table II indicate the "impure" trithiocarbonate significantly increases the amount of Cu recovered; namely from 53.5 percent Cu recovery using the "pure" salt to 74.0 percent Cu recovery using the "impure" salt.

TABLE II

Effect of "Pure" and "Impure" Sodium n-Butyl Trithiocarbonate on Mineral Recovery in Ore Flotation (Ore, Palabora-South America)

| | 40% Aq. Na n-$C_4$ Trithiocarbonate | | | | |
|---|---|---|---|---|---|
| | Control - "Pure" | | Invention - "Impure" | | |
| | Run 1 | Run 2 | Run 1 | Run 2 | Run 3 |
| A. Rougher Tails, | | | | | |
| Sample Wt., grams | 965 | 978 | 979 | 975 | 977 |
| Cu, grams | 1.93 | 1.97 | 1.07 | .98 | 1.07 |
| B. Concentrate, | | | | | |
| 1. First Float | | | | | |
| Sample, wt., grams | 10.09 | 11.44 | 11.72 | 15.54 | 11.00 |
| Cu, grams | 1.92 | 1.95 | 2.26 | 2.47 | 2.34 |
| 2. Second Float | | | | | |
| Sample, wt., grams | 4.77 | 4.57 | 7.48 | 5.57 | 4.70 |
| Cu, grams | .343 | .128 | .534 | .640 | .66 |
| C. % Recovery of Cu | 53.9 | 53.1 | 72.3 | 76.0 | 73.8 |
| Average = | | 53.5 | | 74.0 | |

TABLE I

Effect of "Pure" and "Impure" Sodium n-Butyl Trithiocarbonate on Mineral Recovery in Ore Flotation (Ore, Kennecott-Chino Mining Co.)

| | 40% Aq, Na, n-$C_4$ Trithiocarbonate | | | | | |
|---|---|---|---|---|---|---|
| | Control - "Pure"[a] | | | Invention - "Impure"[a] | | |
| | Run 1 | Run 2 | Run 3 | Run 1 | Run 2 | Run 3 |
| A. Rougher Tails, grams | | | | | | |
| Sample Wt. | 1387 | 1413 | 1376 | 1367 | 1373 | 1401 |
| Mo | .035 | .037 | .030 | .033 | .033 | .031 |
| Cu | 2.30 | 2.92 | 2.44 | 2.34 | 2.88 | 2.63 |
| Fe | 288.4 | 288.8 | 281.9 | 279.4 | 297.3 | 291.3 |
| B. Rougher Concentrate, grams | | | | | | |
| Sample Wt. | 104.59 | 65.63 | 107.16 | 121.40 | 75.89 | 81.55 |
| Mo | .167 | .165 | .153 | .165 | .161 | .170 |
| Cu | 11.7 | 10.4 | 12.0 | 13.5 | 11.4 | 11.3 |
| Fe | 37.8 | 18.6 | 37.7 | 45.1 | 21.9 | 27.2 |
| C. % Recovery | | | | | | |
| Mo | 82.8 | 81.8 (average 82.7) | 83.5 | 83.4 | 83.0 (average 83.7) | 84.6 |
| Cu | 83.6 | 78.1 (average 81.6) | 83.1 | 85.2 | 79.9 (average 82.1) | 81.1 |
| Fe | 11.6 | 6.05 (average 9.8) | 11.8 | 13.9 | 6.86 (average 9.8) | 8.54 |

[a]0.03 lb/ton ore of 40 weight percent aqueous solution

EXAMPLE V

This example is a control describing a standard ore flotation process which is used herein to evaluate mineral collectors. To a ball mill was charged 1025 grams of a lead/zinc-containing ore (Ozark Lead Co.), 350 milliliters water along with 0.05 lb/ton Z-11 collector (0.5% aqueous sodium isopropyl xanthate), 1.33 lb/ton $ZnSO_4$ (5% aqueous), 0.1 lb/ton NaCN (1% aqueous) and 0.03 lb/ton MIBC frother (methyl isobutyl carbinol) and the mixture ground for eleven minutes. The slurry was then transferred to a 3 liter Wemco flotation cell and sufficient water was added to give a pulp density of about 35% solids. The sample was conditioned for one minute at 1000 rpm while 0.01 lb/ton Z-11 collector was added and the pH adjusted to 8.4 and floated for 6 minutes to give a lead concentrate. The liquid level was restored and 0.05 lb/ton NaCN, and 0.25 lb/ton $CuSO_4$ were added plus enough lime to adjust the pH to 9.5 during the one minute conditioning period. The pulp was floated for 6 minutes to give the zinc concentrate. The concentrates were filtered and dried in a forced-draft oven at 110° C. The tails were coagulated by addition of Superfloc-16 (American Cyanamid), the excess water decanted, filtered and dried in a Raytheon (Radar Line Model QMP 1785, 18 Magnatron tubes) microwave oven in 20–45 minutes. The concentrate samples were ground in a Techmar Analytical Mill A-10 and analyzed for percent Pb, Zn and Fe. The tails were ground in a Microjet-2 Cross Beater Mill (5 liter), a representative sample removed and analyzed as above. The analyses were performed on a Siemans X-ray fluorescence spectrograph. These results are listed in Table III.

TABLE III

Sodium Isopropyl Xanthate as a Pb, Zn, and Fe Collector[a]
Ozark Ore, .06 lb/ton Collector[a]

| Run | Concentrate, % Recovery | | | | | | Total % Recovery | | |
|---|---|---|---|---|---|---|---|---|---|
| | 1st Float (Pb) | | | 2nd Float (Zn) | | | | | |
| No. | Pb | Zn | Fe | Pb | Zn | Fe | Pb | Zn | Fe |
| 1 | 83.11 | 15.92 | 25.07 | 7.73 | 47.41 | 3.74 | 90.84 | 63.33 | 28.81 |
| 2 | 82.81 | 11.22 | 24.30 | 8.72 | 55.26 | 3.71 | 91.53 | 66.48 | 28.01 |
| averages = | 82.96 | 13.57 | 24.69 | 8.23 | 51.33 | 3.73 | 91.18 | 64.9 | 28.4 |

[a]80% of collector added at grind stage, 20% balance added before first float (Pb).

EXAMPLE VI

This example is a control and illustrates the effectiveness of adding impure sodium n-butyl trithiocarbonate prepared according to Example I as a collector at the grind stage. The procedure described in Example V was repeated with the exception that the Z-11 xanthate collector was replaced with "impure" sodium n-butyl trithiocarbonate (40% aqueous solution. The results are listed in Table IV where it can be seen that the percent recovery of Pb and Zn is decreased when sodium n-butyl trithiocarbonate is added at the grind stage.

TABLE IV

Impure Sodium n-Butyl Trithiocarbonate as a Pb, Zn, Fe Collector[a] - Added at Grind Stage
Ozark Ore, .06 lb/ton Collector[a]

| Run | Concentrate, % Recovery | | | | | | Total % Recovery | | |
|---|---|---|---|---|---|---|---|---|---|
| | 1st Float (Pb) | | | 2nd Float (Zn) | | | | | |
| No. | Pb | Zn | Fe | Pb | Zn | Fe | Pb | Zn | Fe |
| 1 | 82.79 | 35.19 | 25.64 | 8.02 | 13.69 | 3.01 | 90.81 | 48.88 | 28.65 |
| 2 | 84.27 | 43.37 | 25.78 | 7.15 | 14.27 | 3.11 | 91.42 | 57.64 | 28.89 |

TABLE IV-continued

Impure Sodium n-Butyl Trithiocarbonate as a Pb, Zn, Fe Collector[a] - Added at Grind Stage
Ozark Ore, .06 lb/ton Collector[a]

| Run | Concentrate, % Recovery | | | | | | Total % Recovery | | |
|---|---|---|---|---|---|---|---|---|---|
| | 1st Float (Pb) | | | 2nd Float (Zn) | | | | | |
| No. | Pb | Zn | Fe | Pb | Zn | Fe | Pb | Zn | Fe |
| 3 | 75.78 | 38.94 | 23.84 | 7.48 | 12.87 | 2.80 | 83.26 | 51.81 | 26.60 |
| averages = | 80.95 | 39.17 | 25.09 | 7.55 | 13.61 | 2.97 | 88.49 | 52.78 | 28.0 |

[a]80% of collector added at grind stage, 20% balance added before first float (Pb).

EXAMPLE VII

This example is the invention and illustrates the effectiveness of "impure" sodium n-butyl trithiocarbonate as a Zn collector when added before the float as compared to addition at the grind stage. The procedure described in Example V was repeated with the exception that only 0.03 lb/ton Z-11 xanthate collector was added at the grind stage, 0.01 lb/ton Z-11 xanthate collector added just before the first float (Pb) and 0.033 lb/ton "impure" trithiocarbonate added just before the second float (Zn). These results which are listed in Table V show a significant increase in Zn recovery and a slight Fe recovery increase compared to when the collector is added at the grind stage (Example VI, Table IV).

TABLE V

Impure Sodium n-Butyl Trithiocarbonate as a Pb, Zn, Fe Collector[a] - Added at the Zn Float Step
(Ozark Ore)

| Run | Concentrate, % Recovery | | | | | | Total % Recovery | | |
|---|---|---|---|---|---|---|---|---|---|
| | 1st Float (Pb) | | | 2nd Float (Zn) | | | | | |
| No. | Pb | Zn | Fe | Pb | Zn | Fe | Pb | Zn | Fe |
| 1 | 82.5 | 9.31 | 24.3 | 8.77 | 85.7 | 7.02 | 91.27 | 95.01 | 31.32 |
| 2 | 83.5 | 10.50 | 24.3 | 7.43 | 84.7 | 5.17 | 90.93 | 95.20 | 29.47 |
| 3 | 82.5 | 9.47 | 24.5 | 6.21 | 85.3 | 5.12 | 88.71 | 94.77 | 29.60 |
| averages = | 82.8 | 9.76 | 24.37 | 7.47 | 85.23 | 5.77 | 90.30 | 95.00 | 32.10 |

[a].033 lb/ton ore of a 40% aqueous solution.

SUMMARY

The data disclosed in Examples V, VI, and VII is summarized in Table VI where it is shown that adding "impure" sodium n-butyl trithiocarbonate just before the Zn float greatly enhances the recovery of Zn.

TABLE VI

Summary of Data (From Examples I Through VII)

| Flotation Steps | Controls: Example V | Controls: Example VI | Invention Example VII |
|---|---|---|---|
| A. Grind (11 mins.) | | | |
| $ZnSO_4$, lb/ton | 1.33 | 1.33 | 1.33 |
| NaCN, lb/ton | .10 | .10 | .10 |
| Methyl Isobutyl Carbinol, lb/ton | .03 | .03 | .03 |
| Z-11, lb/ton | .05 | — | .03 |
| "impure" Sodium n-Butyl Trithiocarbonate lb/ton | — | .05 | — |
| B. First Float for Pb (pH 8.4) 6 mins. | | | |
| Z-11, lb/ton | .01 | — | .01 |
| "impure" Sodium n-Butyl Trithiocarbonate | — | .01 | — |
| % Recovery,[a] | | | |
| Pb | 82.96 | 80.95 | 82.80 |
| Zn | 13.57 | 39.17 | 9.76 |
| Fe | 24.69 | 25.09 | 24.37 |

TABLE VI-continued

| Summary of Data (From Examples I Through VII) | | | |
|---|---|---|---|
| | Controls | | |
| Flotation Steps | Example V | Example VI | Invention Example VII |
| C. Second Float for Zn (pH 9.5), 6 mins. | | | |
| $CuSO_4$, lb/ton | .25 | .25 | .25 |
| NaCN, lb/ton | .05 | .05 | .05 |
| "impure" Sodium n-Butyl Trithiocarbonate, lb/ton | — | — | .033 |
| % Recovery, | | | |
| Pb | 8.23 | 7.55 | 7.47 |
| Zn | 51.33 | 13.61 | 85.23 |
| Fe | 3.73 | 2.97 | 5.77 |
| D. Total % Recovery, | | | |
| Pb | 91.18 | 88.49 | 90.30 |
| Zn | 64.9 | 52.78 | 95.00 |
| Fe | 28.4 | 28.06 | 30.14 |

[a]Percent recovery values given are for three runs except Example V which is the average of two runs.

methyl ether, MW 450) and flotation was carried out for 8 minutes. A sample of the concentrate and tails was filtered, dried and analyzed. The procedure was repeated except a 40% aqueous solution of "impure" sodium n-butyl trithiocarbonate, 0.18 pounds per ton, was used instead of the 40% aqueous blend of mercaptobenzothiazol and a dialkyl dithiophosphate. The results are listed in Table VII where it can be seen that the use of "impure" sodium n-butyl trithiocarbonate not only increases the percent recovery of Fe but significantly increases the percent recovery of U while maintaining the same Au recovery.

EXAMPLE IX

This example describes the process whereby the inventive composition (dispersant and "impure" trithiocarbonate) was evaluated as a mineral collector. To a

TABLE VII

| Effect of Collector on % Recovery of Fe, U, Au | | | | | | | | | | | |
|---|---|---|---|---|---|---|---|---|---|---|---|
| Run | Rougher Tail | | | | Rougher Concentrate | | | | % Recovery | | |
| No. | Wt. g | Fe, g | U, ppm[c] | Au, oz/ton | Wt. g | Fe, g | U, ppm[c] | Au, oz/ton | Fe | U | Au |
| Control[a] | | | | | | | | | | | |
| 1. | 670.6 | 1.48 | 938 | .008 | 10.80 | 3.47 | 194 | .360 | 70.10 | 17.14 | 97.83 |
| 2. | 612.8 | 1.29 | 552 | .009 | 10.96 | 3.92 | 164 | .284 | 75.24 | 22.91 | 96.93 |
| | | | | | | | | Average = | 72.67 | 20.02 | 97.38 |
| Invention[b] | | | | | | | | | | | |
| 3. | 611.2 | 1.41 | 511 | .008 | 11.11 | 3.66 | 579 | .344 | 72.19 | 48.66 | 97.73 |
| 4. | 638.9 | 1.41 | 638 | .009 | 13.26 | 4.54 | 344 | .308 | 76.30 | 35.03 | 97.16 |
| | | | | | | | | Average = | 74.25 | 41.85 | 97.45 |

[a]0.2 lb/ton mercaptobenzothiazol and dialkyl dithiophosphate blend.

[b].18 lb/ton sodium n-butyl trithiocarbonate

[c]100 parts per million = .01 wt. %

EXAMPLE VIII

This example describes an inventive and control run illustrating the effectiveness of "impure" sodium n-butyl trithiocarbonate in floating pyrite and particularly in floating precious metals such as gold and uranium contained within the pyrite. An 800 gram sample of ore tailings obtained from the Rand Mines, Johanesburg, South Africa and having a Tyler mesh screen size of +65, 26%; −65/+100, 29%; −100/+200, 41%; and −200, 4% was deslimed by washing three times with water and the water decanted. The washed ore was transferred to a 2.5 liter size Denver flotation cell along with 1200 mL water to make about a 32% solids slurry. The slurry was stirred at 1100 rpm. To the stirred slurry was added enough 10% aqueous $H_2SO_4$ to adjust the pH to 2.5 and 0.3 lb/ton $CuSO_4$ (1% aqueous) and the slurry conditioned for 8 minutes. To the solution was then added 0.2 lb/ton of a blend of mercaptobenzothiazol and a dialkyl dithiophosphate as a 40% aqueous solution (0.1 pound per ton Senkol 50, 0.1 pound per ton Senkol 65 available from Senmin Chemicals Co.) and the mixture condition for 2 minutes. To the mixture was added 0.15 lb/ton frother (polypropylene glycol monoball mill was charged 1000 grams of a copper-containing ore (Bougainville Copper Ore) and 800 milliliters of water. The mixture was ground for 4 minutes and transferred to 2.5 Liter capacity Denver D-12 flotation cell. Also added to the cell was 6 grams per metric ton (g/mt) of methyl isobutyl carbinol plus any collector or collector blend being tested. The slurry was conditioned in the cell for 2 to 3 minutes at 1200 rpm and floated for 3 minutes. The concentrate was removed, more collector added to the cell and floated a second time for 5 minutes. Again the concentrate was removed, more collector added to the cell and floated a third time for 10 minutes. The first concentrate was filtered, dried and analyzed. The second and third concentrates were combined, filtered, dried and analyzed. Table VIII shows the results when a 40 weight percent aqueous solution of sodium n-butyl trithiocarbonate is employed as a collector. Runs 1 and 2, and compared to when a water-soluble dispersant like polypropylene glycol monomethyl ether is pre-blended with the aqueous collector (Runs 3 and 4). The results show a significant increase in weight percent recovery of both Cu and Fe in the first float and an increase in the total average weight percent recovery of both Cu and Fe when the inventive composition of aqueous sodium n-butyl trithiocarbonate and poly(propylene glycol)monomethyl ether is employed.

TABLE VIII

Effect of Polypropylene Glycol Dispersant on the Efficiency of Sodium n-Butyl Trithiocarbonate as a Mineral Collector (1000 grams Bougainville Cu Ore)

| Run | Run Collector | Concentrate Wt. g | Concentrate % Cu | Concentrate % Fe | Wt. % Recovery Cu | Wt. % Recovery Fe | Average Wt. % Recovery Cu | Average Wt. % Recovery Fe |
|---|---|---|---|---|---|---|---|---|
| Control: | | | | | | | | |
| 1 | n-Butyl Trithiocarbonate[a] | | | | | | | |
| | a. First Float, 0.9 g/mt[b] | 12.1 | 13.2 | 13.5 | 38.46 | 5.70 | | |
| | b. Second Float, 0.9 g/mt + Third Float, 1.7 g/mt | 25.5 | 4.8 | 11.8 | 29.33 | 10.53 | | |
| | c. Tails | 950 | 0.141 | 2.52 | — | — | | |
| 2 | n-Butyl Trithiocarbonate[a] | | | | | | | |
| | a. First Float, 0.9 g/mt | 12.8 | 13.0 | 13.1 | 40.19 | 5.08 | | |
| | b. Second Float, 0.9 g/mt + Third Float, 1.7 g/mt | 25.3 | 5.58 | 15.9 | 34.14 | 12.16 | | |
| | c. Tails | 950 | 0.112 | 2.86 | — | — | | |
| | | | | | First Float = | | 39.32 | 5.40 |
| | | | | | Second and Third Float = | | 31.74 | 11.35 |
| | | | | | Total = | | 71.06 | 16.75 |
| Invention: | | | | | | | | |
| 3 | 95% n-Butyl Trithiocarbonate + 5% Dowfroth 1012[c] | | | | | | | |
| | a. First Float, 0.9 g/mt | 23.3 | 9.93 | 10.9 | 49.36 | 8.51 | | |
| | b. Second Float, 0.9 g/mt + Third Float, 1.7 g/mt | 29.9 | 3.91 | 12.0 | 25.00 | 12.03 | | |
| | c. Tails | 934 | 0.129 | 2.54 | — | — | | |
| 4 | 95% n-Butyl Trithiocarbonate + 5% Dowfroth 1012[c] | | | | | | | |
| | a. First Float, 0.9 g/mt | 13.4 | 13.1 | 13.1 | 42.31 | 5.74 | | |
| | b. Second Float, 0.9 g/mt + Third Float, 1.7 g/mt | 28.8 | 4.47 | 12.7 | 31.01 | 11.93 | | |
| | c. Tails | 946 | 0.117 | 2.67 | — | — | | |
| | | | | | First Float = | | 45.84 | 7.13 |
| | | | | | Second and Third Float = | | 28.00 | 12.00 |
| | | | | | Total = | | 73.84 | 19.13 |

[a]40 Wt. % aqueous sodium n-butyl trithiocarbonate
[b]Grams per metric ton
[c]Poly(propylene glycol)monomethyl ether, MW 400

EXAMPLE X

This example demonstrates the effectiveness of the inventive collector-dispersant pre-blend on other type ores. The procedure described in Example IX was generally followed except with a different type ore. When a Pb-Zn ore was used there was added Zn suppressants in the Pb float (0.85 lb/ton $ZnSO_4$ and 0.1 lb/ton NaCN) and a Zn activator (0.2 lb/ton $Cu_2SO_4$) in the Zn float. These results are listed in Table IX where it can be seen in Part A that the inventive collector blend increases the weight percent recoveries of both Cu and Zn. The Fe recovery appears to decrease slightly. With the Pb-Zn ore in Part B the inventive collector-dispersant increases the percent recovery of Pb in the Pb float while greatly decreasing the recovery of Zn in the Pb float.

TABLE IX

Effect of Dispersant-Collector Blend on Cu, Pb, Zn, Fe Separation

A. 1000 Grams Canada Wide Ore

| Run No. | Collector | Concentrate Wt. g | Concentrate % Cu | Concentrate % Zn | Concentrate % Fe | Wt. % Recovery Cu | Wt. % Recovery Zn | Wt. % Recovery Fe | Average Wt. Recovery Cu | Average Wt. Recovery Zn | Average Wt. Recovery Fe |
|---|---|---|---|---|---|---|---|---|---|---|---|
| Control: | | | | | | | | | | | |
| 1 | n-Butyl TTC[a] | | | | | | | | | | |
| | a. 1st Float, .034 lb/T | 107.4 | 9.81 | 0.69 | 21.7 | 91.46 | 71.96 | 24.02 | | | |
| | b. 2nd Float, .017 lb/T | 40.4 | 0.75 | 0.09 | 11.7 | 2.63 | 3.53 | 4.87 | | | |
| | c. Tails | 841.0 | 0.081 | 0.03 | 8.2 | — | — | — | | | |
| 2 | n-Butyl TTC[a] | | | | | | | | | | |
| | a. 1st Float, .034 lb/T | 106.6 | 11.5 | 0.84 | 22.9 | 93.06 | 61.91 | 24.24 | | | |
| | b. 2nd Float, .017 lb/T | 38.8 | 0.86 | 0.12 | 14.6 | 2.53 | 3.22 | 5.63 | | | |
| | c. Tails | 841.0 | 0.069 | 0.06 | 8.4 | 4.40 | — | — | | | |
| | | | | | | | First Float = | | 92.26 | 66.79 | 24.13 |
| | | | | | | | Second Float = | | 2.58 | 3.38 | 5.25 |
| | | | | | | | Total = | | 94.84 | 70.17 | 29.38 |
| Invention: | | | | | | | | | | | |
| 3 | 95% n-Butyl TTC + 5% Dowfroth 1012[b] | | | | | | | | | | |
| | a. 1st Float, .034 lb/T | 100.5 | 12.2 | 0.86 | 22.8 | 93.74 | 74.32 | 21.99 | | | |
| | b. 2nd Float, .017 lg/T | 35.1 | 0.75 | 0.12 | 14.8 | 2.01 | 3.62 | 4.98 | | | |

TABLE IX-continued

Effect of Dispersant-Collector Blend on Cu, Pb, Zn, Fe Separation

| | | | | | | | | | | |
|---|---|---|---|---|---|---|---|---|---|---|
| | c. Tails | 855.4 | 0.065 | 0.03 | 8.9 | 4.25 | 22.05 | 73.02 | | |
| 4 | 95% n-Butyl TTC + 5% Dowfroth 1012[b] | | | | | | | | | |
| | a. 1st Float, .034 lb/T | 99.8 | 11.9 | 0.89 | 4.67 | 93.10 | 52.21 | 5.65 | | |
| | b. 2nd Float, .017 lb/T | 40.6 | 0.8 | 10.12 | 16.0 | 2.57 | 2.86 | 7.87 | | |
| | c. Tails | 849.0 | 0.06 | 50.09 | 8.4 | — | — | — | | |
| | | | | | | | First Float = | | 93.42 | 63.27 | 13.82 |
| | | | | | | | Second Float = | | 2.29 | 3.24 | 6.42 |
| | | | | | | | Total = | | 95.71 | 66.51 | 20.24 |

[a]40 Wt. % Aqueous sodium n-butyl trithiocarbonate
[b]Poly(propylene glycol)monomethyl ether, MW 400

B. 1000 Grams Ozark Lead Ore (0.85 lb/t $ZnSO_4$, 0.1 lb/t NaCN)

| Run No. | Collector | Concentrate Wt. g | % Pb | % Zn | % Fe | Wt. % Recovery Pb | Zn | Fe | Average Wt. Recovery Pb | Zn | Fe |
|---|---|---|---|---|---|---|---|---|---|---|---|
| Control: | | | | | | | | | | | |
| 1 | n-Butyl TTC[a] | | | | | | | | | | |
| | a. Pb Float, 0.09 lb/T | 108.2 | 57.6 | 5.8 | 0.95 | 74.9 | 53.3 | 6.32 | | | |
| | b. Zn Float[b] | 28.2 | 38.5 | 6.84 | 1.16 | 13.0 | 16.4 | 2.01 | | | |
| 2 | n-Butyl TTC[a] | | | | | | | | | | |
| | a. Pb Float, 0.09 lb/T | 112.2 | 56.6 | 5.2 | 1.01 | 84.5 | 49.7 | 6.63 | | | |
| | b. Zn Float | 18.7 | 29.1 | 10.6 | 1.53 | 7.22 | 16.9 | 1.67 | | | |
| | | | | | | | Pb Float = | | 79.7 | 51.5 | 6.5 |
| | | | | | | | Zn Float = | | 10.1 | 16.7 | 1.8 |
| | | | | | | | Total = | | 89.8 | 68.2 | 8.3 |
| Invention: | | | | | | | | | | | |
| 3 | 95% n-Butyl TTC + 5% Dowfroth 1012[c] | | | | | | | | | | |
| | a. Pb Float, 0.09 lb/T | 102.3 | 63.1 | 2.3 | 0.87 | 82.6 | 20.7 | 5.28 | | | |
| | b. Zn Float[b] | 10.8 | 15.7 | 3.86 | 1.68 | 2.17 | 3.66 | 1.08 | | | |
| 4 | 95% n-Butyl TTC + 5% Dowfroth 1012[c] | | | | | | | | | | |
| | a. Pb Float, 0.09 lb/T | 102.5 | 61.1 | 2.7 | 0.91 | 81.2 | 25.7 | 5.72 | | | |
| | b. Zn Float[b] | 18.4 | 29.4 | 2.6 | 1.65 | 7.02 | 4.44 | 1.86 | | | |
| | | | | | | | Pb Float = | | 81.9 | 23.2 | 5.5 |
| | | | | | | | Zn Float = | | 4.6 | 2.8 | 1.5 |
| | | | | | | | Total = | | 86.5 | 26.0 | 7.0 |

[a]40 Wt. % Aqueous sodium n-butyl trithiocarbonate
[b]0.2 lb/T $CuSO_4$ added to Zn float as a Zn activator
[c]Poly(propylene glycol)monomethyl ether, MW 400

Reasonable variations such as would occur to one of ordinary skill in the art may be made herein without departing from the scope of the invention.

That which is claimed is:

1. In a process for the recovery of the values of lead, iron and copper from the froth in an ore flotation process, the improvement which comprises employing as a collection agent for said values in said process an effective amount of a preblended aqueous composition consisting essentially of (a) a dispersant of the formula:

$$HO\left(CHR'\underset{\underset{CH_3}{|}}{C}H-O\right)_y R'$$

wherein R′ is either hydrogen, methyl or ethyl and y is an integer from 6 to 17, said dispersant having a molecular weight from about 300 to about 1000, and (b) the total reaction product resulting from the process which comprises:

(1) reacting sodium hydroxide with n-butyl mercaptan; and thereafter adding to the resulting reaction product carbon disulfide in an amount sufficient to effect formation of an aqueous composition of sodium n-butyl trithiocarbonate, (2) thereafter adding to the resulting reaction product carbon disulfide in an amount sufficient to effect formation of the desired aqueous composition, the ratio of (b) and (a) being from about 80:20 to about 99:1 parts by weight.

2. A process according to claim 1 wherein the dispersant in said preblended aqueous composition is poly(propylene glycol) monomethyl ether.

3. A process according to claim 1 wherein said preblended aqueous composition is employed before each flotation step in the ore recovery process.

4. A process according to claim 1 wherein said collection agent is used in an amount from about 0.005 lb/ton or ore to 0.5 lb/ton of ore.

5. A process according to claim 4 wherein said collection agent is used in an amount from about 0.01 lb/ton of ore to 0.1 lb/ton of ore.

* * * * *